US006622626B2

(12) United States Patent
Stuhlmiller et al.

(10) Patent No.: US 6,622,626 B2
(45) Date of Patent: Sep. 23, 2003

(54) METHOD OF STARTING UP A ROTARY OFFSET PRINTING MACHINE

(75) Inventors: Helmut Stuhlmiller, Altenmünster (DE); Reinhard Zeller, Augsburg (DE)

(73) Assignee: Man Roland Druckmaschinen AG, Offenbach am Main (DE)

( * ) Notice: Subject to any disclaimer, the term of this patent is extended or adjusted under 35 U.S.C. 154(b) by 21 days.

(21) Appl. No.: 10/076,811

(22) Filed: Feb. 15, 2002

(65) Prior Publication Data

US 2002/0108522 A1 Aug. 15, 2002

(30) Foreign Application Priority Data

Feb. 15, 2001 (DE) ..... 101 06 986

(51) Int. Cl.[7] ..... B41F 31/02
(52) U.S. Cl. ..... 101/484; 101/483; 101/365
(58) Field of Search ..... 101/483, 484, 101/365

(56) References Cited

U.S. PATENT DOCUMENTS

| | | | | |
|---|---|---|---|---|
| 5,148,747 A | | 9/1992 | Rodi et al. | 101/450 |
| 5,784,960 A | | 7/1998 | Gensheimer et al. | 101/352.09 |
| 5,845,574 A | | 12/1998 | Dilling et al. | 101/351.6 |
| 5,907,999 A | * | 6/1999 | Lusar et al. | 101/484 |
| 6,006,664 A | | 12/1999 | Hummel et al. | 101/350.4 |
| 6,109,177 A | | 8/2000 | Wech et al. | 101/349.1 |
| 6,318,260 B1 | * | 11/2001 | Chu et al. | 101/365 |
| 6,477,954 B1 | * | 11/2002 | Doherty | 101/365 |

FOREIGN PATENT DOCUMENTS

| | | | | |
|---|---|---|---|---|
| DE | 0 529 257 | | 3/1993 | |
| EP | 529257 A1 | * | 3/1993 | B41F/31/04 |
| GB | 2 312 186 | | 10/1997 | B41F/31/04 |
| GB | 2328903 | | 3/1999 | B41F/31/16 |
| JP | 2001246733 A | * | 7/2001 | B41F/31/02 |

* cited by examiner

*Primary Examiner*—Daniel J. Colilla
(74) *Attorney, Agent, or Firm*—Cohen, Pontani, Lieberman & Pavane

(57) ABSTRACT

A rotary offset printing machine having printing units each with a dampening unit and an inking unit with a metering device for setting an inking profile zone can reach the continuous printing state quickly and with little accumulation of rejects. First an inking profile is set on the metering device that is the inverse of the inking profile for continuous printing with the applicator rolls set off the printing plate and the machine operating at a first rotational speed. A defined quantity of ink is supplied to the inking unit, the inking profile for continuous printing then being set on the metering device. The rubber blankets are pre-dampened and, when a third rotational speed is reached, the print is set on. Finally, the printing machine is run up to a fourth speed for continuous printing when the separation of rejects is concluded.

5 Claims, 2 Drawing Sheets

METHOD OF STARTING UP A ROTARY OFFSET PRINTING MACHINE

BACKGROUND OF THE INVENTION

1. Field of the Invention

The invention relates to a method of starting up a rotary offset printing machine of the type having printing units, each printing unit having a printing plate cylinder, a rubber blanket cylinder for transferring ink from the printing plate cylinder to a web being printed, a dampening unit for dampening the printing plate cylinder, applicator rolls which can be set onto and off of the printing plate cylinder, an inking unit for applying ink to the applicator rolls, and a metering device for supplying a defined quantity of ink to the cleaned inking unit.

2. Description of the Related Art

When starting up a rotary offset printing machine, for example at the start of a new production run, the aim is to reach the operating state for continuous printing quickly, in order to keep the wastage low. With regard to the quantity of printing ink and dampening solution supplied to the printing plate, settings have to be made. The inking units of the printing units have a metering device on which passage openings for the printing ink can be adjusted zone by zone, that is to say distributed over the width of the inking unit or the printing plate. It is known to set these openings in accordance with the subject on the printing plate, that is to say in accordance with the consumption of the individual inking zones. With this setting an input of ink is carried out with the ink applicator rolls set off. An inking profile set in this way is illustrated hatched in FIG. 1. Within the context of setting the print on, the ink applicator rolls are also set onto the printing plate, on which an ink layer or an ink density S builds up at the printing locations. The build-up of the ink density is shown in FIG. 2, by the dashed curve, as a function of the number of prints or copies made. The desired layer thickness or ink density $S_F$ for continuous printing is only established after about 1500 copies in zones with a low area coverage, and these copies have to be considered waste. In the case of the procedure described for starting up the printing machine, it is in particular disadvantageous that zones with a low ink consumption, for example zone 1, with the low quantity of ink supplied need a very long time until the desired layer thickness on the printing locations of the printing plate is achieved. In this way, for example register marks are printed visibly only after a relatively long time has elapsed. As opposed to this, the initially plentiful supply of printing ink in an inking zone with a high ink consumption, for example in the inking zone 3, leads to overinking of the printing areas.

EP 0 529 257 B1 sets an inverse ink profile on the ink metering device after an interruption to the printing process, such as during the daily new start after washing the rubber blanket. It is virtually the case that, in an inking zone with a low ink consumption, an exaggeratedly high amount of ink is supplied to the inking unit, and in an inking zone with a high ink consumption, exaggeratedly little ink is supplied to the inking unit. In this case, the ink applicator rolls are set on, in order in addition to permit the subject on the printing plate to have a back effect.

SUMMARY OF THE INVENTION

It is an object of the invention to provide a method of starting up a rotary offset printing machine in which the continuous printing state can be reached quickly and with little accumulation of waste.

According to the invention, the method includes the following steps

- setting an inking profile on the metering device which is the inverse of an inking profile for continuous printing,
- metering a defined quantity of ink to the cleaned inking unit according to said inverse profile with the applicator rolls set off the printing plate cylinder and the machine operating at a first rotational speed,
- accelerating the machine to a second rotational speed,
- accelerating the machine from the second rotational speed to a third rotational speed,
- pre-dampening the rubber blanket cylinder,
- setting the inking profile to the profile for continuous printing while the machine is being accelerated from the second rotational speed to the third rotational speed, and
- executing a print on sequence when the third rotational speed is reached.

By virtue of the well coordinated method steps, only very little wastage is produced by the time the continuous printing state is reached.

Other objects and features of the present invention will become apparent from the following detailed description considered in conjunction with the accompanying drawings. It is to be understood, however, that the drawings are designed solely for purposes of illustration and not as a definition of the limits of the invention, for which reference should be made to the appended claims. It should be further understood that the drawings are not necessarily drawn to scale and that, unless otherwise indicated, they are merely intended to conceptually illustrate the structures and procedures described herein.

DETAILED DESCRIPTION OF THE PRESENTLY PREFERRED EMBODIMENTS

Starting up the rotary offset printing machine will be explained below using the program sequence illustrated in FIG. 3. The rotary offset printing machine has printing units each having an inking unit and a dampening unit, which dampen and ink the printing plate located on the plate cylinder. Each inking unit contains an ink metering device to set an inking profile zone by zone. In relation to the sequence of method steps to be carried out, the rotational speed of the printing machine is specified on the ordinate and the accumulated number of copies is specified on the abscissa. Starting up the rotary printing machine starts up with loading the production run, as it is known, stored data for the machine setting being called up from a memory, for example settings of the folder or of the stream register. The printing machine is then driven at a first rotational speed n1 of the plate cylinder. This is advantageously the threading speed of about 600 rev/h. The web to be printed has already been threaded into the printing machine. The dryer for the paper web is then activated, that is to say its preheating is started.

Figure 1:
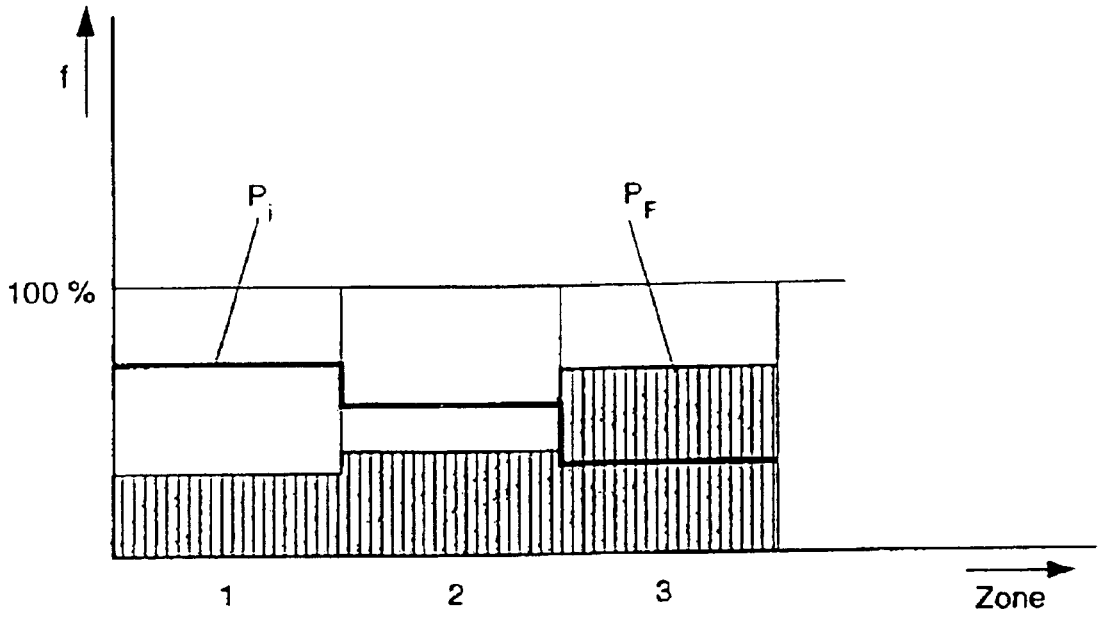
FIG. 1 shows an inking profile for continuous printing and an inking profile that is its inverse, in an extract.

At the first rotational speed n1, the metering devices of the inking units of the printing units of the rotary offset printing machine are, furthermore, set to an inverse inking profile. The metering device is, for example, zone screws for inking zones, into which the inking unit is divided over its width, as has already been explained at the beginning in the prior art. With the zone screws, for each inking zone it is possible to set the height f of a passage gap for the printing ink between an ink knife and an ink ductor. The settings of all the heights f of the inking zones supply an inking profile, as illustrated hatched in FIG. 1. To dimension the inverse profile, the starting point is the inking profile $P_F$ for continuous printing. This is obtained, for example, by scanning the printing plate. In the process, the area coverage of the print is determined in each zone and, from this, the percentage opening f of the passage gap of each inking zone is defined. The difference from 100% passage supplies the value of the inverse inking profile $P_i$ of the respective inking zone, as plotted in FIG. 1. In the case of this inversely set inking profile, the cleaned inking unit is now fed a defined quantity of ink, it is preinked. For this purpose, after the inking profile on the ductor has reached the region of the film roll, the latter is set onto the ductor and, during a specific number of plate cylinder revolutions, for example two revolutions, and at a specific ductor rotational speed (for example 2 to 3 rev/min), ink is transported into the inking unit. During this time, the ink applicator rolls and damping solution applicator rolls are set off the plate cylinder. The film roll is then set off the ductor again, and the inking profile $P_F$ for continuous printing is set on the ink metering device.

The printing machine is then run up to a second rotational speed n2 of about 5000 rev/h and remains at this speed until the dryer is released. In this case, this is the indication that the dryer is ready for continuous printing, for which purpose, for example, flaps on the dryer have to be closed. As a rule, the dryer release is carried out as early as during the method steps carried out at the first rotational speed n1, so that the printing machine is immediately accelerated to a third rotational speed n3 of about 16 000 rev/h without remaining at the second rotational speed n2. During this acceleration, the rubber blankets are pre-dampened. This is carried out at short intervals by means of the rubber blanket washing system. The rubber blankets are already in a clean condition. Initial moistening prevents the web sticking when the print is subsequently set on.

When running at the third rotational speed n3, the print on sequence is then carried out. This includes:

a) driving the damping solution ductor b) driving the ink ductor c) setting the damping solution applicator roll on d) setting the metering device onto the inking unit (film roll on)

e) setting the ink applicator rolls on i) setting the print on.

In addition, the inking register and the cut register are switched on (switched to active). Finally, when good printed copies are achieved, the rejects diverter is set to the "good" position and the counting of the copies is started (nett counter on). The printing machine is then run up to a fourth rotational speed n4 for continuous printing, for example 70 000 rev/h. This acceleration is carried out relatively slowly, for example over a time period of 180 seconds, as a result of which the copies printed in the process are saleable production and therefore not rejects.

At the end of production, that is to say when the desired number of copies has been printed, the rejects diverter is set to the "poor" position and the counting of the copies is terminated (nett counter off). After receiving the dryer release, which signals that the dryer is able to process increased solvent concentrations, for example caused by washing solutions (flaps of the dryer opened), the shut-down sequence is executed. This includes setting the print off, setting the metering device off (film roll off), setting the ink applicator rolls off and setting the dampening solution applicator rolls off. The printing machine is then run down to a fifth rotational speed n5 of about 20 000 rev/h. During the deceleration, the inking unit is washed and, in the process, is brought into the necessary "empty" state for the above-described start-up of the printing machine for a new production run. Washing of the rubber blankets is carried out at the rotational speed n5. The printing machine is then stopped.

Figure 2:
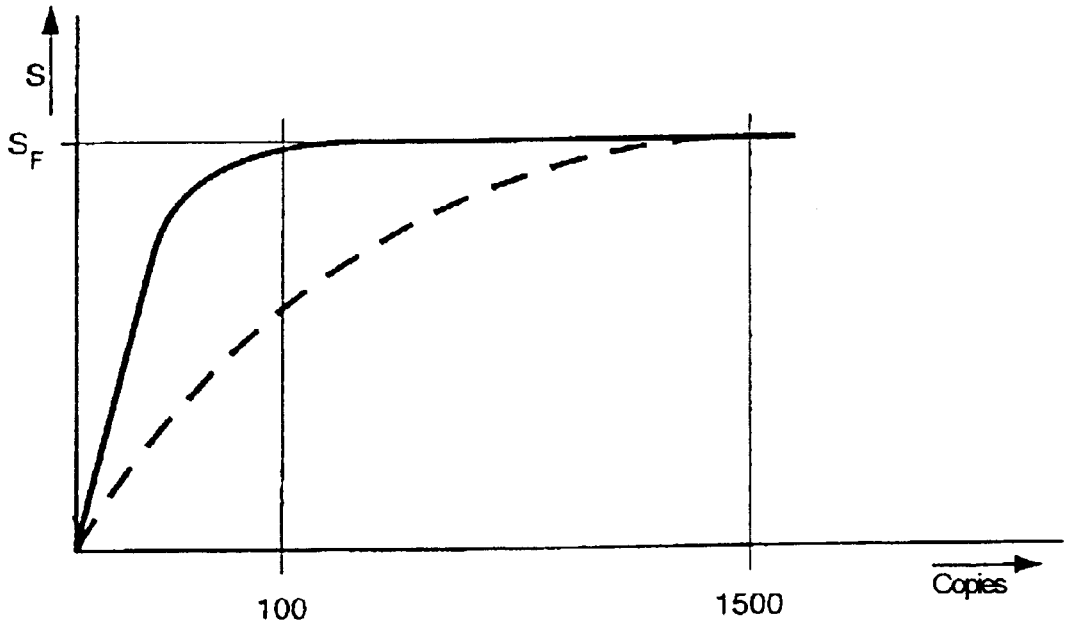
FIG. 2 shows inking curves (ink densities) as a function of the number of prints for one setting of an ink metering device for continuous printing and with an inverse setting.
Figure 3:
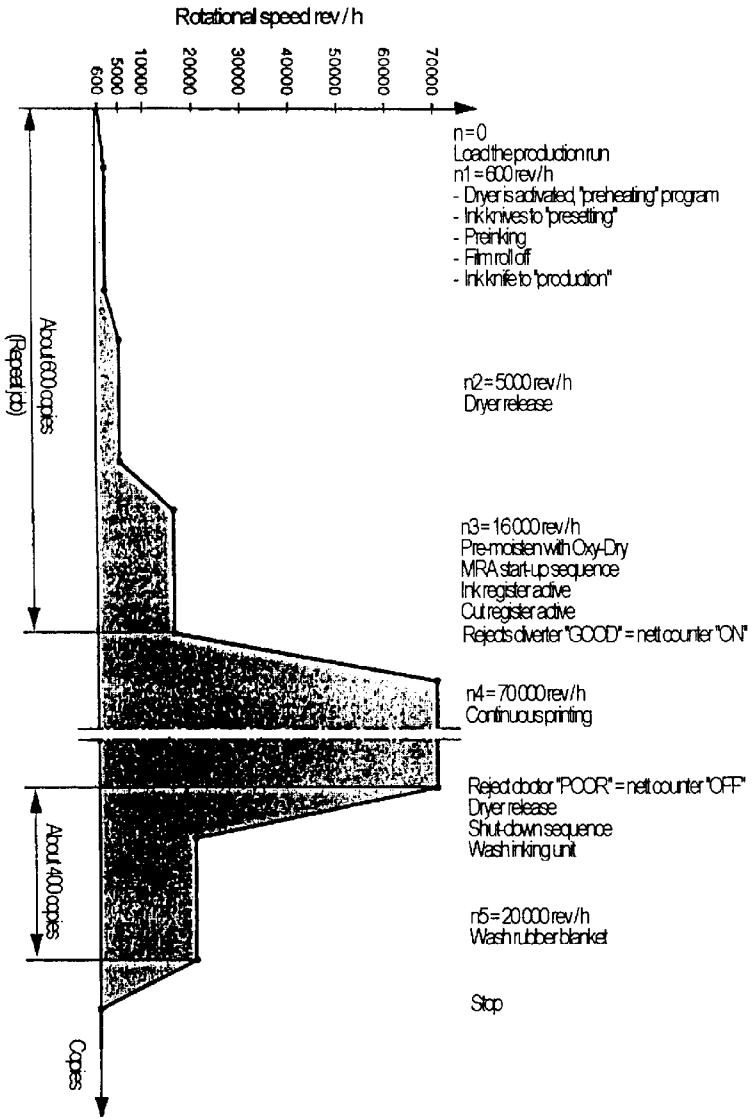
FIG. 3 shows a program sequence for starting up a printing machine.

In the case of the program sequence described, about 600 reject copies accumulate until good printed copies are obtained (see FIG. 3). Within the context of this start-up procedure, by virtue of the above-described preinking, the inking unit already supplies the necessary ink density $S_F$ for reject-free printing after about 100 copies (see FIG. 2).

Thus, while there have shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Moreover, it should be recognized that structures and/or elements and/or method steps shown and/or described in connection with any disclosed form or embodiment of the invention may be incorporated in any other disclosed or described or suggested form or embodiment as a general matter of design choice. It is the intention, therefore, to be limited only as indicated by the scope of the claims appended hereto.

We claim:

1. A method of starting up a rotary offset printing machine having printing units, each said printing unit having a printing plate cylinder, a rubber blanket cylinder for transferring ink from the printing plate cylinder to a paper web being printed, a dampening unit for dampening the printing plate cylinder, applicator rolls which can be set onto and off of the printing plate cylinder, said applicator rolls each having a plurality of zones, an inking unit for applying ink to the applicator rolls, and a metering device for supplying a defined quantity of ink to the inking unit, for each said zone, said method comprising:

setting an inking profile on the metering device which is the inverse of an inking profile for continuous printing, metering a defined quantity of ink to the inking unit according to said inverse profile with the applicator rolls set off the printing plate cylinder and the machine operating at a first rotational speed, accelerating the machine to a second rotational speed, accelerating the machine from said second rotational speed to a third rotational speed, pre-dampening said rubber blanket cylinder, setting said inking profile to said profile for continuous printing while said machine is being accelerated from said second rotational speed to said third rotational speed, and executing a print on sequence when the third rotational speed is reached.

2. A method as in claim 1 wherein said inverse inking profile in each said zone is approximately the difference between maximum passage of ink and the passage of ink for said profile for continuous printing in said zone.

3. A method as in claim 1 further comprising drying said paper web using a dryer, said printing machine being maintained at said second rotational speed while said dryer is operating.

4. A method as in claim 1 wherein each said inking unit comprises an ink ductor and each said dampening unit comprises a dampening roller, said print sequence comprising:

a) driving the dampening unit, b) driving the ink ductor, c) setting the dampening roller onto the printing plate cylinder, d) setting the metering device onto the ink ductor, e) setting the ink applicator rolls onto the printing plate cylinder, and f) printing the paper web.

5. A method as in claim 1 further comprising separating rejects while said machine is being run at said third rotational speed, and running said printing machine up to a fourth rotational speed after said rejects have been separated.

* * * * *